US008690634B2

(12) United States Patent
Heath et al.

(10) Patent No.: US 8,690,634 B2
(45) Date of Patent: Apr. 8, 2014

(54) INTERNAL SUPPORT STRUCTURE FOR AN ATHLETIC SUPPORT BRA, AND ASSOCIATED METHOD OF FABRICATION

(75) Inventors: Hilary Heath, Louisville, CO (US); Susan Krueger, Providence, RI (US)

(73) Assignee: Sturdy Girl Sports, LLC, Louisville, CO (US)

( * ) Notice: Subject to any disclaimer, the term of this patent is extended or adjusted under 35 U.S.C. 154(b) by 270 days.

(21) Appl. No.: 13/294,899

(22) Filed: Nov. 11, 2011

(65) Prior Publication Data

US 2012/0122370 A1 May 17, 2012

Related U.S. Application Data

(60) Provisional application No. 61/413,181, filed on Nov. 12, 2010.

(51) Int. Cl.
*A41C 3/00* (2006.01)

(52) U.S. Cl.
USPC ..... 450/41; 450/43; 450/40

(58) Field of Classification Search
USPC ..... 450/30–33, 65, 66, 70, 72–76, 40, 41, 450/43, 44, 47, 48, 51, 53, 52
See application file for complete search history.

(56) References Cited

U.S. PATENT DOCUMENTS

| | | | | |
|---|---|---|---|---|
| 2,797,415 | A * | 7/1957 | Spanel et al. | 450/39 |
| 3,311,112 | A * | 3/1967 | Murray | 450/1 |
| 3,544,100 | A * | 12/1970 | Desai | 271/10.09 |
| 4,655,224 | A * | 4/1987 | Stern et al. | 450/36 |
| 5,873,767 | A * | 2/1999 | Pickett | 450/1 |
| 6,015,332 | A * | 1/2000 | Lee et al. | 450/57 |
| 6,179,687 | B1 * | 1/2001 | Lee et al. | 450/88 |
| 6,231,423 | B1 * | 5/2001 | Deal et al. | 450/57 |
| 6,287,168 | B1 * | 9/2001 | Rabinowicz | 450/75 |
| 6,994,606 | B2 * | 2/2006 | Li | 450/82 |
| 7,614,256 | B2 * | 11/2009 | Mitchell | 66/179 |
| 2008/0198578 | A1 * | 8/2008 | Finn | 362/103 |
| 2010/0107312 | A1 * | 5/2010 | Jaraicie | 2/400 |

* cited by examiner

*Primary Examiner* — Gloria Hale
(74) *Attorney, Agent, or Firm* — Lathrop & Gage LLP

(57) ABSTRACT

A support structure for a bra includes a two-ply structural support layer having an m-shaped ply of compression fabric, forming left and right openings along a bottom aspect of the m-shaped ply, and a w-shaped ply of compression fabric, forming left and right openings along a top aspect of the w-shaped ply. The m- and w-shaped plies are joined together such that the left and right openings of each ply overlap to form left and right pockets for accommodating at least a portion of a wearer's left and right breasts. The support structure encapsulates and separates the breasts. When joined with straps of a sports bra or top, the two-ply structural support layer provides sling-type support of the breasts. Compressive fabric of the bra or top compresses the breasts to a wearer's chest; thus, a bra or top incorporating the support structure provides three-way support via encapsulation, suspension and compression.

20 Claims, 14 Drawing Sheets

INTERNAL SUPPORT STRUCTURE FOR AN ATHLETIC SUPPORT BRA, AND ASSOCIATED METHOD OF FABRICATION

RELATED APPLICATIONS

This application claims priority to Provisional Patent Application No. 61/413,181, filed Nov. 12, 2010 and incorporated herein by reference.

BACKGROUND

Women who have undergone breast augmentation surgery face a challenge in finding a well-fitting sports bra to adequately support their enhanced breasts. Post-augmentation, a woman's breasts are often disproportionately large in comparison with the circumference of her rib cage. While women with naturally large breasts are typically also naturally larger in the rib cage area and/or upper body, women with augmented breasts are often proportionally smaller in the rib cage area and/or upper body, and thus have a disproportionate upper body structure after surgery. Many conventional sports bra cup and band dimensions tend to increase proportionally (for example, sports bras that are sized small, medium, large, etc. rather than specifically sized for cup and band ratios), and therefore provide a poor fit for the augmented figure.

Further, women with augmented breasts need more breast tissue and ligament support than natural breasts, in order to reduce ligament stretching and sagging over time. As women age, both their breast tissue and the suspensory Cooper's ligaments lose elasticity and thin. However, breast implants create a dense, non-changing load on the progressively thinner and weaker Cooper's ligaments. Without proper support, especially during exercise that involves dramatic up and down or side to side motion, augmented breasts may be even more susceptible to sagging than natural breasts. Surgical intervention, implant replacement and/or breast lift, is often required to fix implants that have sagged drastically due to improper support.

A woman with augmented breasts may also experience increased nipple protrusion due to numbness or loss of sensation in nipple tissue—a common side effect of augmentation, occurring in greater than 50% of surgeries. As a result, the nipples are often erect at embarrassing times. Workouts are no exception.

SUMMARY

Disclosed herein is an athletic support bra or other athletic active-wear garment (e.g., a sports tank or other top) including a two-ply structural support layer. The structural support layer includes a roughly "m" shaped ply layered with a roughly "w" shaped ply such that openings formed by the m and w shapes overlap to create pockets for accommodating at least the nipple area of a wearer's breast, and optionally, the entire breast. The m and w plies are cut on different grains to provide different stretch and support in each ply, thus enhancing overall support of the structural support layer. The structural support layer provides a high level of support and motion control for larger sized breasts, for example during exercise. In particular, the support layer properly supports and fits an augmented physique, although the support layer also offers improved support for women with naturally large breasts. A sports bra or sports top incorporating the two-ply structural support layer provides three-way support to a wearer, via breast compression, encapsulation and suspension. For example, the structural support layer provides encapsulation and suspension (i.e., via connections to straps) while an outer fabric layer compresses the breasts and breast area of a wearer.

A bra incorporating the structural support layer includes a spacer fabric lining material or other materials that effectively reduce the appearance of nipple protrusion when molded and sewn into a sports bra or top, affording the wearer with some modesty during exercise. The spacer fabric may be naturally wicking due to the construction of component yarns, and/or may be treated with a moisture management agent that helps to wick sweat from the skin while the wearer is exercising and perspiring. Additional nipple covers attached with the structural support layer further smooth the silhouette of a wearer.

In another aspect, the two-ply support layer is replaced by a support structure with a figure eight construction and provides a high level of support and motion control for larger sized breasts, during exercise. A sports bra or sports top incorporating the figure eight support structure also provides three-way support to a wearer, via breast compression, encapsulation and suspension.

In one embodiment, a two-ply support layer for a bra includes an m-shaped ply of compression fabric forming left and right openings along a bottom aspect of the ply, and a w-shaped ply of compression fabric forming left and right openings along a top aspect of the ply. The w-shaped ply joined with the m-shaped ply such that the left and right openings in the plies overlap to form left and right pockets for accommodating at least the nipples of a wearer's left and right breasts.

In one embodiment, an internal support structure for a bra includes a two-ply structural support layer and an interior liner for contacting a wearer's skin. The two-ply structural support layer has an m-shaped ply of compression fabric forming left and right openings along a bottom aspect of the m-shaped ply, and a w-shaped ply of compression fabric forming left and right openings along a top aspect of the w-shaped ply. The w-shaped ply joined with the m-shaped ply such that the left and right openings of the plies overlap to form left and right pockets for accommodating at least a wearer's nipples. The interior liner joins with an interior aspect of the two-ply structural layer and has left and right molded cups fitted with and into the left and right pockets, for accepting and encapsulating the wearer's left and right breasts.

In one embodiment, an athletic support bra for providing suspension, encapsulation and compression includes an exterior front shell made of a compressive fabric to reduce motion of a wearer's breasts during exercise. A spacer layer beneath the exterior front shell minimizes appearance of a wearer's nipples, camouflages underlying layers and enhances breast compression. A two-ply structural support layer beneath the spacer layer includes a w-shaped ply of fabric and an m-shaped ply of fabric joined to form left and right breast pockets. A liner layer beneath the two-ply structural support layer includes left and right cups formed from a spacer material and joined with the two-ply structural support layer such that at least a portion of the left cup fits within the left pocket and at least a portion of the right cup fits within the right pocket. Left and right shoulder straps are formed with or joined with the exterior front layer and further joined with the spacer layer, the two-ply structural support layer and the liner layer. An exterior back side made with a compressive fabric is joined with (a) the shoulder straps, and (b) at least the exterior front shell. Elastic joined with a bottom border of the athletic support bra forms a continuous ribcage band. The two-ply structural support layer and the liner layer encapsulate the wearer's breasts, the juncture of the straps with the two-ply structural support layer provides suspension support of the breasts, and the compressive fabric compresses the breasts to the wearer's chest.

In one embodiment, an athletic support bra provides suspension, encapsulation and compression, and includes an exterior front layer made of a compressive fabric to reduce motion of a wearer's breasts during exercise. A middle support structure is joined with the exterior layer and includes a plurality of support bands joined together to form a figure-eight structure bordering right and left pockets. The joined support bands provide suspension support and encapsulation of the wearer's breasts. A liner layer includes seamless, molded cups formed from a spacer material and joined with the middle support structure such that the molded cups fit within the right and left pockets to enhance encapsulation of the breasts. Left and right shoulder straps join with the exterior layer, the middle support structure and the liner layer at a front seam above the molded cups. An exterior back side made with a compressive fabric joins with (a) the shoulder straps at seams corresponding with a wearer's upper back, and (b) at least the exterior front layer and the liner layer of the combined front layer, support structure and liner layer front layer. Woven elastic joins with a bottom border of the athletic support bra to form a continuous ribcage band.

DETAILED DESCRIPTION

Figure 1:
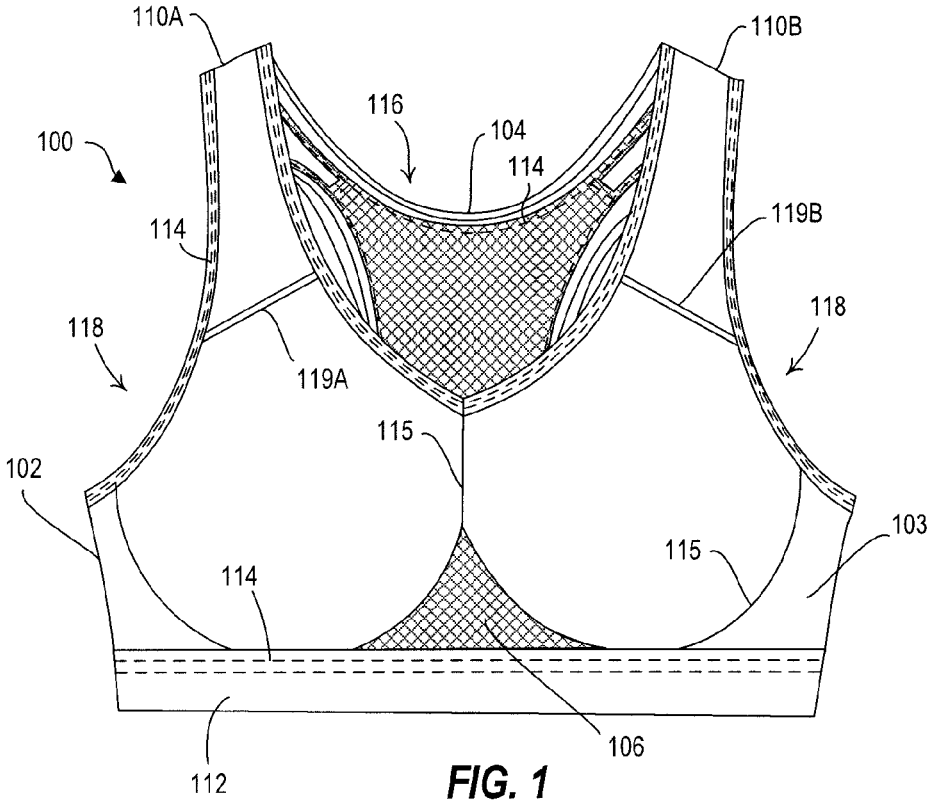
FIG. 1 shows an exterior front side of an athletic support bra, according to an embodiment.
Figure 2:
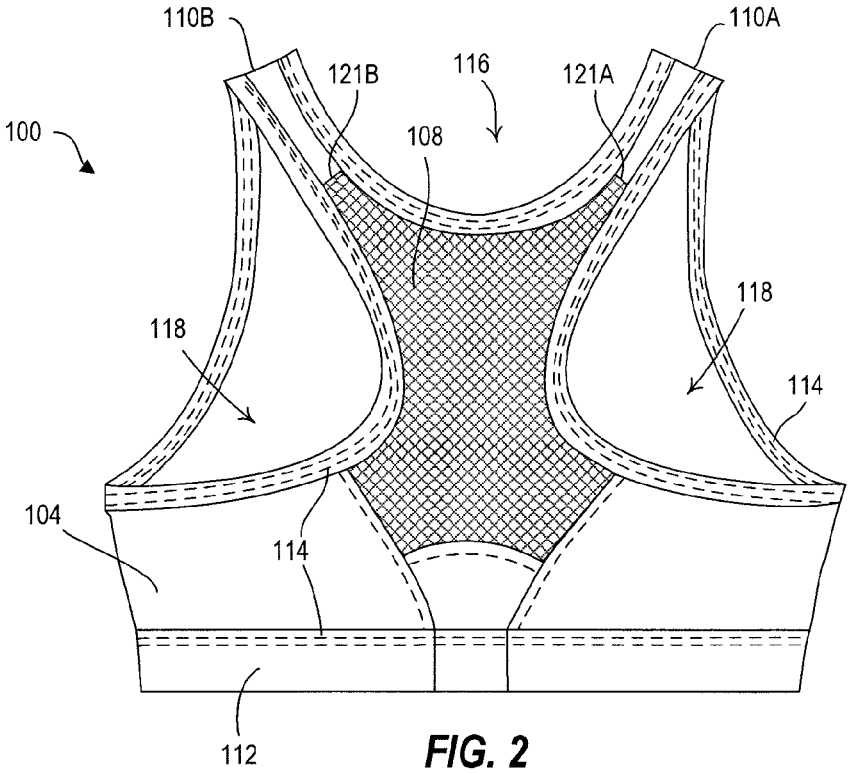
FIG. 2 is an exterior back view of the bra of FIG. 1.

FIGS. 1 and 2 show an athletic support bra (or sports bra) 100. In one embodiment, sports bra 100 includes a multi-layer front side 102 (FIG. 1) that joins with a back side 104 (see also FIG. 2). An exterior layer or shell 103 of front side 102 faces outward towards the viewer in FIG. 1. An inner liner layer, a two-ply structural layer and a spacer layer of front side 102 are shown and described with respect to FIGS. 3-8. Although shown as separate pieces, it will be appreciated that front and back sides 102 and 104 may alternately be formed of a unitary exterior shell that is joined together at the sides of the bra, for example, along seams under a wearer's armpits.

Shell 103 is formed with a compression fabric to reduce motion by pressing a wearer's breasts against her chest. In one example, shell 103 includes a compression jersey fabric such as a dense, a 4-way stretch polyester wicking fabric as commonly sold under the trademark COOLMAX® and a man-made elastane or spandex technical fabric as commonly sold under the trademark Lycra® to compress and manage moisture during exercise. Back side 104 of bra 100 may also be made of a wicking, compression jersey fabric to enhance compression and moisture management. Back side 104 may additionally be lined with a low stretch tech sheen fabric. Wicking properties of exterior shell 103 and/or back 104 draw moisture from within bra 100 to the exterior of bra 100, to facilitate evaporation, cooling and drying. Additionally, exterior shell 103 and/or back side 104 may include a variety of functional and/or decorative materials. As shown, exterior shell 103 has an inset panel 106 of contrasting fabric (contrasting with the majority fabric of exterior shell 103), and back 104 has an inset panel 108 of a contrasting fabric. It will be appreciated that size and shape of contrasting fabrics may vary without departing from the scope hereof. Further, contrasting fabrics may provide contrast in appearance without sacrificing compression and moisture management properties of bra 100. In one aspect, panels 106 and 108 are made with a compression jersey fabric (i.e., the dense, 4-way stretch polyester commonly sold under the trademark COOLMAX® and the man-made elastane or spandex technical fabric mentioned above) that bears a print different from fabric used elsewhere on front 102 and back 104. Panel 108 (and the entire back and straps of other bra designs shown and described herein) may also be lined with tech sheen for additional support.

In another aspect, panels 106 and 108 are made with mesh, such as a single mesh polyester and spandex fabric, to enhance compression. In one example, mesh panels 106 and 108 are a single, 82% polyester and 18% spandex mesh or other lightweight, breathable and wicking mesh. Alternately or additionally, bra 100 may include one or more cut-outs (e.g., in the back, along one or more shoulder straps, above a bra-band or elsewhere).

Bra 100 is shown with a v-neck, racer back shape. However, it will be appreciated that the appearance of bra 100 is not limited to the drawings. Bra 100 may take on an alternate appearance without departing from the scope hereof, for example, a scoop neck or square neck, a cross-back or a standard back where straps do not cross or join together. Bra 100 may also incorporate front, side or rear openings or mesh panels (for example, above band 112) to facilitate ventilation and cooling.

Bra 100 includes two shoulder straps 110 and a band 112 for snugly fitting with a wearer's ribcage. Together, straps 110 and band 112 secure and anchor bra 100 with the wearer's body. Band 112 and straps 110, together with support features described further with respect to FIGS. 3-8, support and protect a wearer's breasts from undue movement (i.e., due to running, jumping or other exercise) through combined compression, suspension and encapsulation of the breasts. Stitching 114, illustrated by dotted lines, joins various materials and/or layers of bra 100. Stitching 114 for example joins exterior shell 103 with middle and inner front layers of bra 100 (described with respect to FIGS. 3-5, below). In another example, stitching 114 joins elastic or other fabric of band 112, elastic or other fabric lining neck opening 116 and armholes 118, and/or fabric of panels 106 and 108 with the body (i.e., primary material) of bra 100. It will therefore be appreciated that where used herein, dotted lines represent stitching 114, and do not necessarily indicate hidden structure. However, lines 115, defining and extending above and to the sides of panel 106 may represent either design detail or seams, even though dotted lines are not used.

Shoulder straps 110 adjoin front side 102 with back side 104. Straps 110 may be continuous straps extending from a front strap junction 119 to a back strap junction 121. Seams holding straps 110 to front 102 and back 104 of bra 100 are for example at front (upper chest) and back (upper back) junctions 119 and 121, thus reducing rubbing and chafing at the top of the wearer's shoulders.

In one aspect, straps 110 include an outer compression fabric, an inner spacer material for cushioning, and a lining for contact with the skin. Although fabric of straps 110 stretches slightly to accommodate slight variances in body dimensions, straps 110 do not include any adjustable parts, thus preventing wear on the user's skin and loosening of the straps during motion.

Band 112 may be a woven elastic rib band that is about 1⅛-1⅜" wide. In one aspect, band 112 is 1³⁄₁₆" in finished width. Band 112 adjoins with front 102 and back 104 to encircle the wearer's rib cage and support and uphold the wearer's breasts from beneath. Band 112 may be constructed from woven ribbed elastic for comfort and moisture management, and is sewn into bra 100 such that it can either show front stitching detail (e.g., as shown in FIGS. 1 and 2) or appear to "float" within bra 100 without visible outer stitching. Woven elastic of band 112 may lie directly against the wearer's skin when bra 100 is worn.

Figure 3:
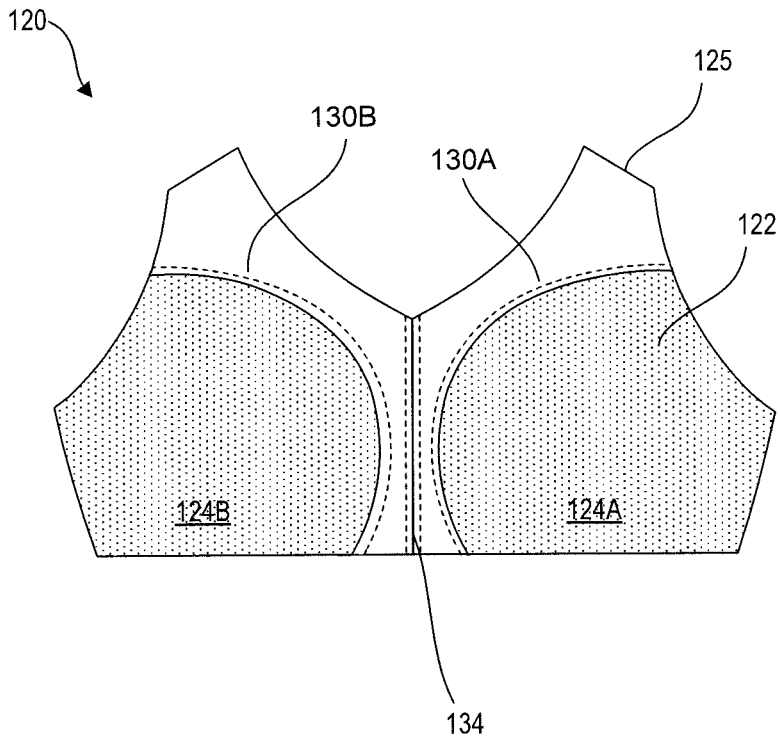
FIG. 3 shows an inner, front lining of the bra of FIGS. 1 and 2, according to an embodiment.

FIG. 3 shows an inner, front liner layer 120 of bra 100. Liner layer 120 (also referred to as "liner 120") forms a first, innermost layer of front side 103 of bra 100. When bra 100 is worn, liner 120 contacts the wearer's skin Liner 120 is shown with a skin contact side 122 facing upwards, towards the viewer. Liner 120 includes two molded, seamless support cups 124. Cups 124 may be heat molded or otherwise molded into a subtle bullet shape or hollow sphere shape for fitting with each breast. Cups 124 enhance encapsulation support of bra 100, and provide sufficient space for the breasts to comfortably and supportively fit with bra 100 without undue squashing by compressive exterior shell 103 (FIG. 1). It will be appreciated that the size and shape of cups 124 may vary according to garment size (e.g., C cup, D cup, DD cup and the like).

In one aspect, cups 124 are molded from nylon/spandex fabric blend, for example a slightly spongy, 90% nylon, 10% spandex material. In addition to encapsulating a wearer's breasts, the spongy nature of cups 124 helps to minimize the appearance of nipple protrusion and lends an overall smoother silhouette to the wearer of bra 100. The material of cups 124 are naturally wicking due to the construction and/or nature of the yarns used, but cups 124 may also be treated with a wicking agent to help draw moisture away from the skin and transport it to the exterior of bra 100 (e.g., to exterior shell 103) for evaporation. Cups 124 may likewise be made of tech sheen, a soft stabilizing tricot or another active wear fabric such as lightweight wicking foam or other material able to hold its shape after molding. Molding advantageously eliminates seams within cups 124, thereby reducing chaffing and discomfort and creating a yet smoother silhouette. Liner fabric 125 above and between cups 124 may be the same as material forming cups 124 (i.e., the slightly spongy, nylon/spandex material mentioned above), or different from the material of cups 124. Cups 124 may be molded into a pre-cut, continuous liner 120, or cups 124 may be molded into a continuous piece of liner fabric which is then cut at its perimeter to dimensions and shape desired for liner 120. Optionally, cups 124 are cut from the same or different material from that forming the body of liner 20, and sewn to liner 120. Although not shown in FIG. 3, liner fabric 125 may also lie below and/or lateral to cups 124. Liner fabric 125 may also include right and left strap liners, as described with respect to FIG. 10, below.

As shown, liner 120 includes two upper, front panels 130 formed of fabric 125, between and above cups 124. Front panels 130 are joined at a center seam or centerline 134 such that left and right sides of liner 120 are substantially symmetric about centerline 134. Centerline 134 may be defined by one or more seams. Alternately, as noted above, liner 120 may be formed of a continuous piece of fabric into which cups 124 are molded.

Figure 4:
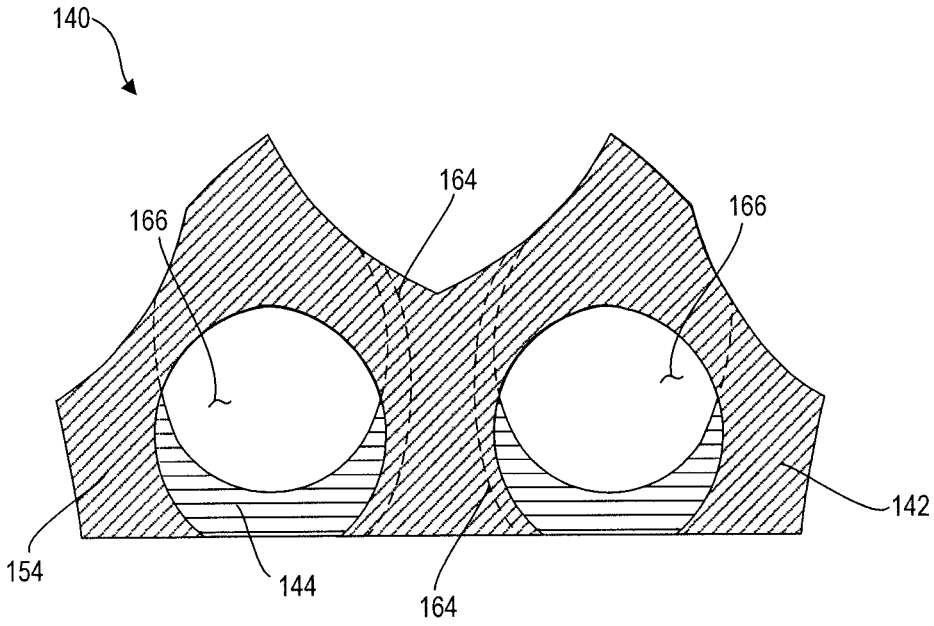
FIG. 4 is a front view of a two ply structural middle layer, found between the exterior front side of FIG. 1 and the lining of FIG. 3, according to an embodiment.
Figure 5:
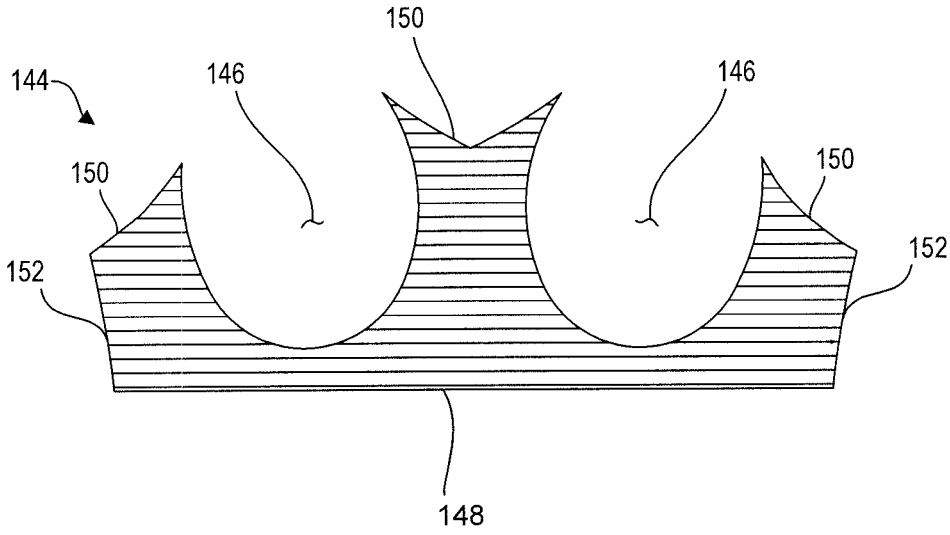
FIG. 5 is a front view a first, w-shaped ply of the structural middle layer of FIG. 4.
Figure 6:
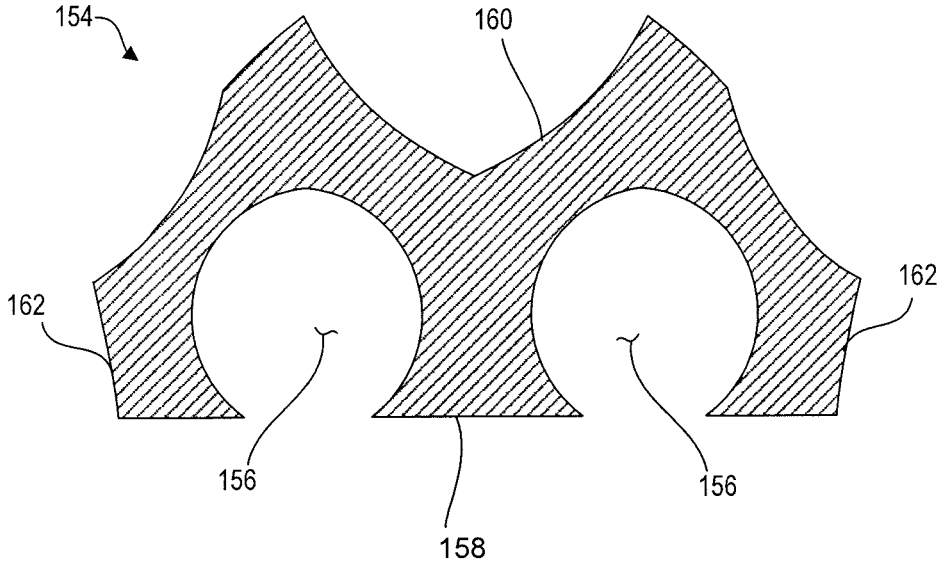
FIG. 6 is a front view a second, m-shaped ply of the structural middle layer of FIG. 4.

FIG. 4 shows a structural, two-ply structural support layer 140 (also referred to herein as a 2-ply support layer, or simply a support layer) of bra 100. FIGS. 5 and 6 separately show the plies of support layer 140. FIGS. 4-6 are best viewed together with the following description.

Two-ply structural support layer 140 is shown with a liner contact side 142 facing towards the viewer. When bra 100 is assembled, liner contact side 142 connects with a back side (opposite skin contact side 122) of liner 120. A layer of spacer fabric (described with respect to FIG. 8) contacts the side of support layer 140 opposite liner contact side 142 when bra 100 is assembled, such that support layer 140 is sandwiched between liner 120 and the spacer layer.

In one aspect, support layer 140 includes first and second layers forming roughly the shape of a "W" and an "M", respectively. As shown, liner contact side 142 has roughly an "M" shape; however, it will be appreciated that the plies of structural support layer 140 may be reversed such that a "W" shaped ply of structural support layer 140 contacts liner 120.

A w-shaped ply 144 (FIG. 5) includes a one-ply layer of fabric (e.g., tech sheen) forming a rough "w" shape with two cutouts 146. Ply 144 joins with band 112 of bra 100 at a bottom edge 148, and for example joins with facing layers (liner 120 on an inner side and an m-shaped ply 154 (FIG. 6) on the opposite side) along broken top edge 150 and lateral edges 152. Plies 154 and 144 are referred to hereinafter as plies 154 and 144. In one aspect, m- and w-shaped plies 154, 144 are at different grains from a supportive material such as low stretch tech sheen. For example, m-shaped ply 154 may be cut cross grain, while w-shaped ply 144 is cut straight grain. When joined together, plies 154 and 144 establish breast separation about centerline 134 and create circular or elliptical openings for accommodating at least the nipples, up to the entire breast, of the wearer. Different grain stretches of plies 154 and 144 enhance bust support of bra 100.

Plies 144 and 154 may be made of a tech sheen material created of about 77% denier nylon and 23% man-made spandex or elastane technical fabric as commonly sold under the trademark Lycra®. In one example, the nylon is EFA Style 5481 40/13 865 SD nylon. Such tech sheen has very low up-and-down elasticity and stretchability and moderate side-to-side elasticity and stretchability (and also maintains its shape and support of the breasts over time). Cutting one of plies 144, 154 straight grain and the other cross grain thus enhances overall support, as areas of moderate stretch are overlaid/underlaid with a lesser stretch cut of fabric. Alternately, m-shaped ply 154 and w-shaped ply 144 are made with another supportive, low-stretch fabric such as powernet.

Figure 7:
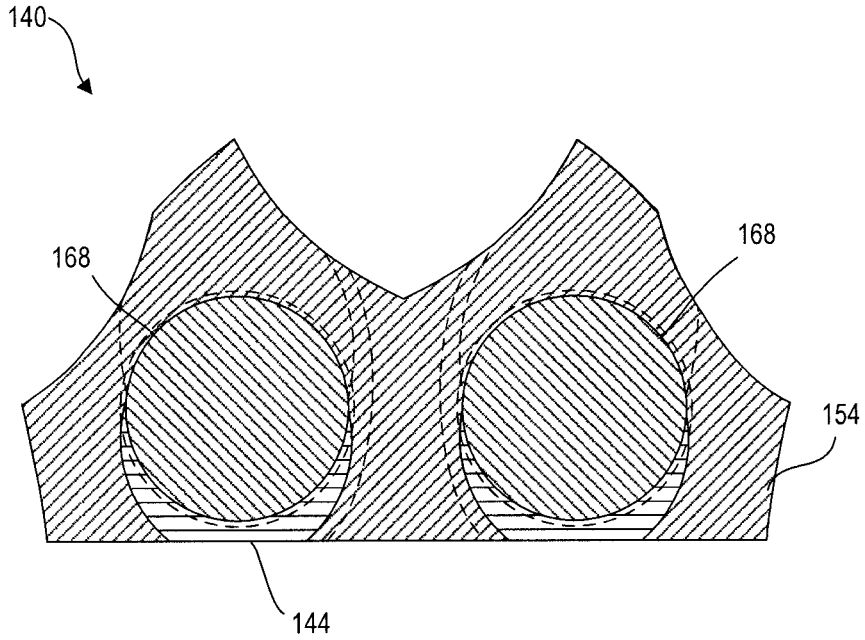
FIG. 7 is a front view of the structural middle layer of FIG. 4 assembled with nipple covers, according to an embodiment.

M-shaped ply 154 with two cutouts 156 joins with W-shaped ply 144 (and/or other layers or components of bra 100) along a bottom edge 158, along a top edge 160 and along lateral edges 162. Plies 144 and 154 may also be joined at center seams 164 (FIG. 4). When plies 144 and 154 are overlaid and secured together to form 2-ply structural support layer 140, cutouts 146 and 156 form circular openings or pockets 166 (FIG. 4). In one embodiment, nipple covers 168 join with support layer 140 to cover pockets 166, thus padding and reducing appearance of a wearer's nipples. FIG. 7 shows nipple covers 168 attached with structural support layer 140. Nipple covers are for example made of slightly molded polyester, and in one aspect, are about two inches in diameter.

Figure 8:
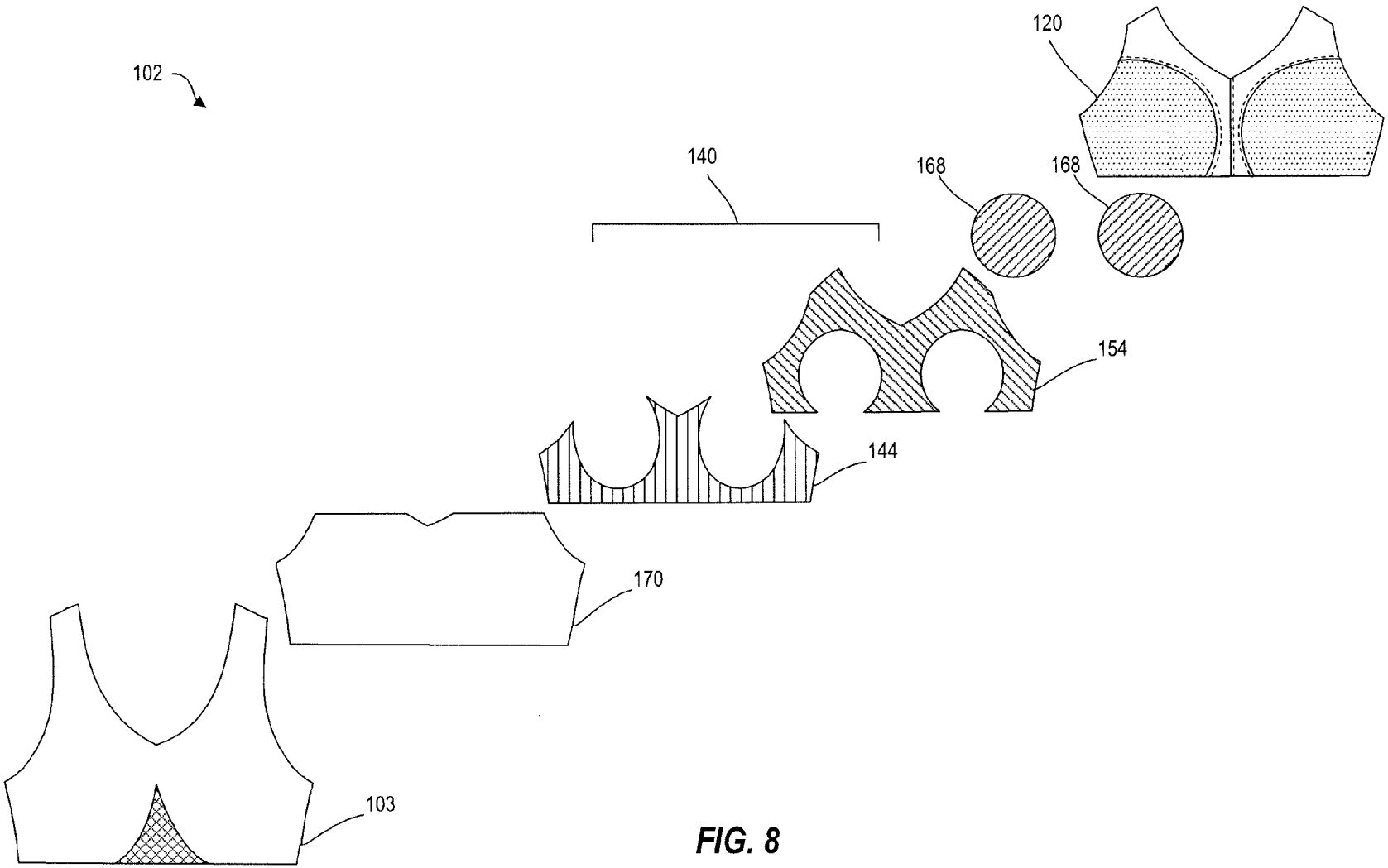
FIG. 8 is a pre-assembly view of the front side of the bra of FIG. 1, showing an additional spacer layer between the structural middle layer of FIG. 4 and the front side of FIG. 1, according to an embodiment.

Support layer 140 may be heat melded, sewn, adhered or otherwise adjoined into bra 100, for example joining with shoulder straps 110, sides of bra 100, optionally, with band 112 and with liner 120. In one aspect, support layer 140 may also join directly with exterior shell 103; however, a spacer layer may also lie between structural support layer 140 and exterior shell 103, as illustrated in FIG. 8. Because structural support layer 140 is joined with bra 100 between liner 120 and exterior shell 103 (with or without the spacer layer), it does not contact the wearer's skin and is not readily visible to the wearer. In one aspect, support layer 140 is sewn directly to shoulder straps 110 and adjacent layers and surfaces with a flat lock, zigzag or other stitch that encourages adjacent layers and surfaces to lie flat against one another. Connecting support layer 140 with straps 110 provides sling-type support under and around each breast, supporting the Cooper's ligaments and aiding in stabilizing the breasts. Support layer 140 additionally encapsulates the breasts to minimize side-to-side and up-and-down bouncing. Molded cups 124, which fit into pockets 166, enhance encapsulation support.

FIG. 8 is a pre-assembly view of bra 100 featuring an additional spacer layer 170 between support layer 140 and exterior shell 103. Spacer layer 170 is formed with a spongy nylon/spandex fabric blend, a soft stabilizing tricot, a lightweight foam, tech sheen or another active wear fabric. In one aspect, spacer layer 170 is formed of a naturally wicking material for wicking moisture from within bra 100 to exterior shell 103. Spacer layer 170 helps to minimize the appearance of a wearer's nipples under bra 100. Spacer layer 170 may be molded to a desired shape to enhance appearance of bra 100 and/or increase support. Exterior shell 103, spacer layer 170, support layer 140 (with nipple covers 168 attached) and liner 120 may be sewn together at once, for example using a stitch that encourages adjacent surfaces to lie flat against one another. Alternately, spacer layer 170, support layer 140 and liner 120 may first be joined together, and the joined structure sewn to exterior shell 103.

Figure 9:
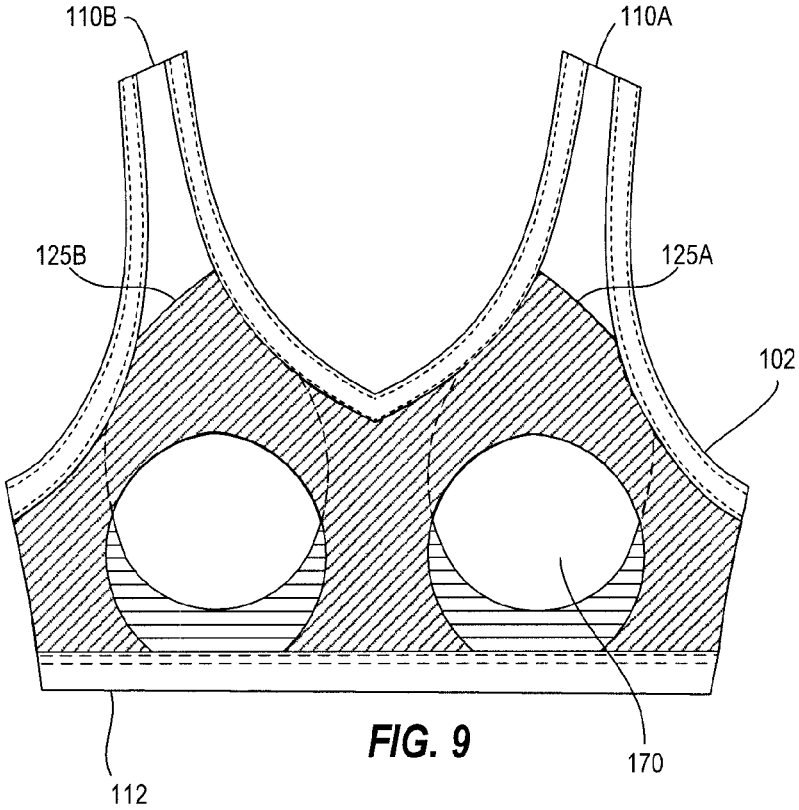
FIG. 9 is an inner view of the front side of the bra of FIG. 1, assembled with the supportive middle layer of FIG. 4.
Figure 10:
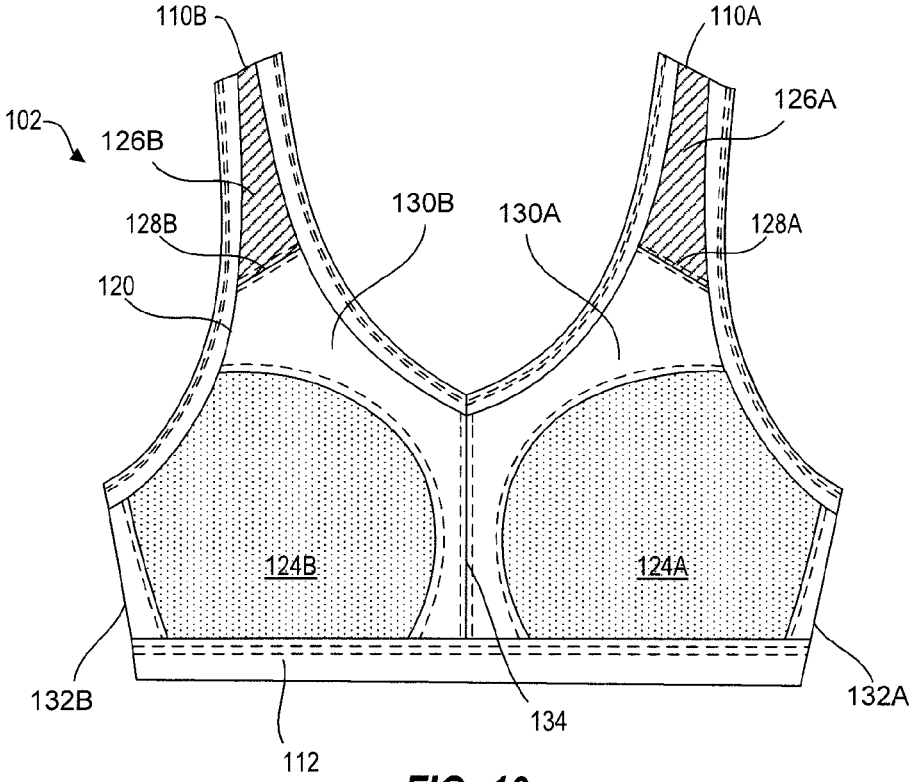
FIG. 10 is an inner view of the front side of the bra of FIG. 1, assembled with the inner lining of FIG. 3.

FIG. 9 is a skin-side up, schematic drawing showing support layer 140 and spacer layer 170 assembled with front exterior shell 103. Nipple covers 168 are not included in FIG. 9, in order to show spacer layer 170 through pockets 166. FIG. 10 is a skin-side up, schematic drawing of front side 102 with innermost liner 120 atop structural support layer 140. When bra 100 is worn, liner 120 contacts the wearer's skin.

As shown, liner 120 may include right and left strap liners 126A and 126B, for lining right and left straps 110A and 110B. Strap liners 126 may be strips of spongy spacer material, each strip extending from an upper front panel 130 at a front shoulder seam 128, running along the skin-side of right strap 110A or left strap 110B and attaching with an inner, back surface of bra 100 (i.e., the interior of back side 104, FIG. 2). In one aspect, strap liners 126 connect with the inner back surface of bra 100 at rear shoulder junctions/seams 121 (see FIG. 2). Strap liners 126 may alternately may extend across a greater portion of the inner back surface of bra 100, for example where the straps overlie a user's shoulder blades, or where the back surface of bra 100 includes continuous straps that cross over the wearer's back. In a cross-back style, it will be appreciated that rear shoulder junctions 121 may be placed proximate the bottom of a wearer's shoulder blades.

In one embodiment, liner 120 includes a side panels 132 lateral to each cup 124. In one aspect, panels 130 and 132 are made with a spacer material similar or identical to that &liming cups 124 (i.e., the slightly spongy, nylon/ spandex material mentioned above.

During motion, bra 100 stabilizes the breasts and minimizes upward, downward and side-to-side bounce. W-shaped ply 144 of support layer 140 reduces lateral and downward breast motion during movement, while m-shaped ply 154 reduces lateral and upward motion. Support layer 140 encapsulates the breasts to reduces both side-to-side and up-and-down bouncing. M-shaped ply 154 additionally provides suspensory support via its attachment to straps 110 of bra 100 (described above). Compression fabric of shell 103 presses the breasts against the wearer's chest to further limit motion. Exterior shell 103 is for example made with a single jersey, 4-way stretch circular knit, yarn wicking fabric, to provide compression and moisture management through elastic and wicking properties of the fabric, respectively. In one aspect, fabric of exterior shell 103 is 79% polyester wicking fabric as commonly sold under the trademark COOLMAX® and 21% man-made elastane or spandex technical fabric as commonly sold under the trademark Lycra®.

Layers and components of bra 100 (e.g., exterior shell 103, back 104, front liner layer 120, 2-ply structural support layer 140 (m- and w-shaped plies 154 and 144, respectively) or middle support layer 240 (support bands 242-248), shoulder straps 110, band 112, etc.) are adjoined by sewing, heat adjoining or any other suitable method for adjoining fabrics. The regions where any two segments of bra 100 are adjoined are called seams. In one aspect, all seams of bra 100 are flat lock stitched or otherwise stitched in such a way that they lie flat and preferably are sewn such that the edges of adjoining pieces are faced inward toward and against the garment fabric itself, as opposed to rubbing against the wearer's skin. For example, in cases where seams show, they face outward on the external portions of the garment and not against the wearer's skin, in order to reduce the likelihood of rubbing or chafing.

Bra 100 is sewn or otherwise adjoined into one piece and is put on by pulling over the wearer's head and shoulders. A wearer for example pulls the bra over the head and down over the breasts, lifting each breast into the appropriate molded cups 124 and then adjusting position of band 112 and straps 110 as necessary. Bra 100 may be removed by simply gripping band 112, stretching it outward and pulling it up and over the head. By eliminating eyehooks, zippers, Velcro® and other common fasteners, bra 100 reduces chafing, rubbing, pressure marks and abrasions that might be caused by such fasteners rubbing against the wearer's skin. Advantageously, the continuous, one piece design of bra 100 also reduces bra failure, as there are no temporary fasteners to break, bend or over stretch.

Figure 11:
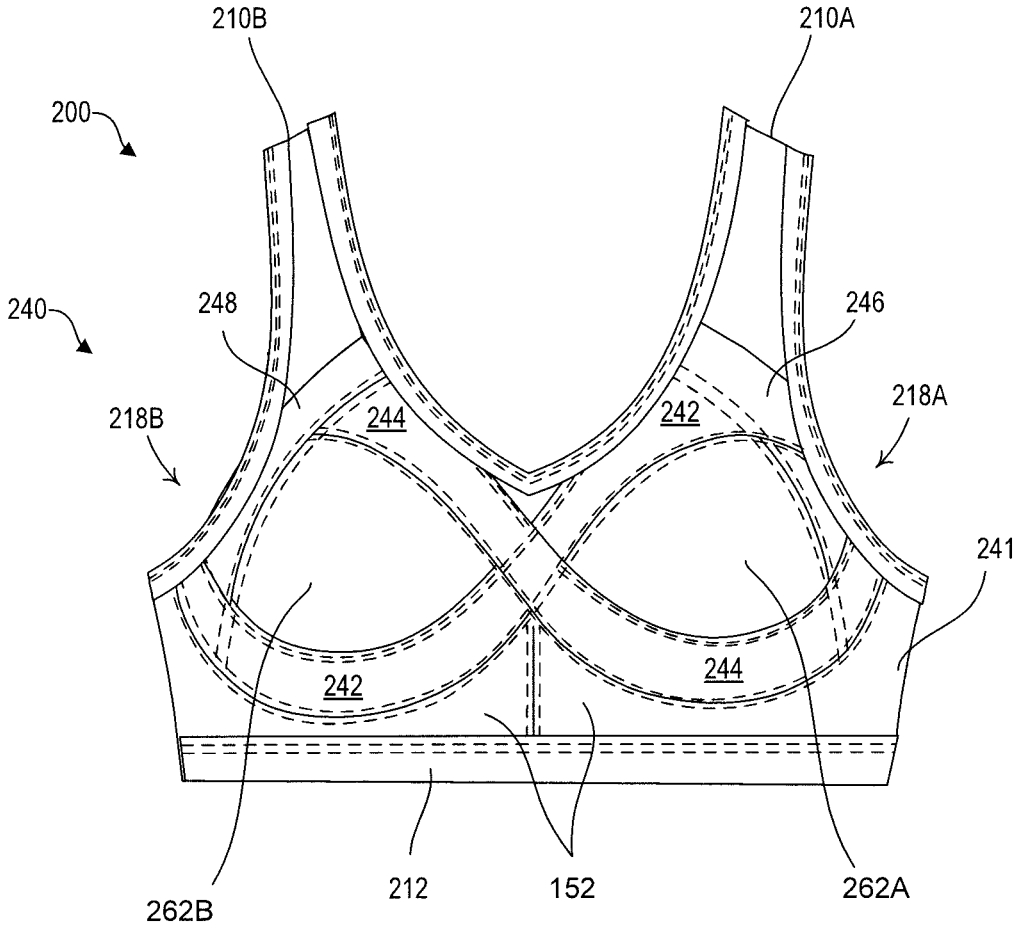
FIG. 11 shows a sports bra incorporating a supportive middle layer, according to an embodiment.

FIG. 11 shows an alternate middle support layer 240, which may for example replace support layer 140 in bra 100 or provide support in an alternate sports bra. Middle support layer 240 is shown attached with an inner front side of a sports bra 200 (which is similar to bra 100), with a liner contact side 241 facing towards the viewer. Layer 240 includes a plurality of support bands 242-248 arranged in a figure eight pattern. Support band 242 extends from the lower left side of middle support layer 240 (proximate a left arm-hole 218B), forms a first arc for fitting beneath a wearer's left breast, and extends upwards and across middle support layer 240 to attach proximate an upper border of a right arm-hole 218A, forming a second arc for fitting over a wearer's right breast. Support band 244 extends from the lower right side of middle support layer 240 (proximate armhole 218A), forms a first arc for fitting beneath a wearer's right breast, and extends upwards and across middle support layer 240 to attach proximate upper left aim-hole 218B. Upper right, and left bands 246 and 248 underlie support bands 242 and 244. Middle support layer 240 fits with the inner front side of bra 200 such that upper right and left bands 246 and 248 attach with lower aspects of bands 244 and 242, respectively, and extend along armholes 218A/218B and across inner surfaces of right and left shoulder straps 210A and 210B of bra 200. Bands 242-248 are joined together in a figure eight shape, for example by stitching. In one aspect, top edges of upper right and left bands 246 and 248 correspond approximately with shoulder seams of bra 200 (not labeled).

Together, bands 242-248 provide upper, lower, middle and lateral support for each breast. Bands 242-248 of middle support layer 240 effectively separate and support the breasts, encapsulating each breast into its own "pocket." Middle support layer 240 also provides sling-type support under and around each breast, when joined with straps 210 and other components of bra 200. Bands 242-248 suspend breast tissue and support the Cooper's ligaments via their attachment with shoulder straps 210 and sides of bra 200. Bands 242-248 are for example made of a tech sheen material created of about 77% denier nylon and 23% man-made elastane or spandex technical fabric as commonly sold under the trademark Lycra®. In one example, the nylon is EFA Style 5481 40/13 865 SD nylon. Such tech sheen has very low up-and-down elasticity and stretchability and moderate side-to-side elasticity and stretchability, and therefore maintains its shape and support of the breasts over time. Alternately, bands 242-248 are made with another supportive, low-stretch fabric such as powernet. Lower panels 252 of bra 200 connect adjoined support bands 242-248 with a bra band 212 when bra 200 is assembled.

The figure eight shape of middle support layer 240 may be heat melded, sewn, adhered or otherwise adjoined into bra 200, for example joining with any or all of shoulder straps 210, sides of bra 200, the inside front of bra 200, bra band 212 and any liner or spacer layers incorporated into bra 200. Although not shown in FIG. 11, in one aspect, bra 200 includes (from outside front to inside front) an exterior layer of compressive fabric similar to exterior shell 103 of bra 100, a spacer layer such as spacer layer 170, for camouflaging support bands 242-248, minimizing nipple protrusion and additionally compressing the breasts, middle support layer 240 and a liner layer such as liner 120. Where a liner layer such as layer 120 is used, middle support layer 240 does not contact the wearer's skin and is not readily visible to the wearer. In one aspect, the figure eight shape of middle support layer 240 is sewn directly to shoulder straps 210 and adjacent layers and surfaces with a flat lock, zigzag or other stitch that encourages adjacent layers and surfaces to lie flat against one another.

Bands 242 and 244 provide suspension support, which is enhanced by their connection to shoulder straps 210A and 210B, via connection to upper right and left bands 246 and 248, and is also enhanced by bra band 212. Bands 242-248 together provide encapsulation-type support. Where a liner such as liner 120 is used, support is enhanced by molded liner cups (see, e.g., cups 124) that fit into pockets 262 defined by connected bands 242-248. Finally, bra 200 has sufficient elasticity to fit tightly with the body after being stretched during try-on, providing compression-type support to a wearer's breasts (for example, compression is provided by the front of bra 200 and may be enhanced by a sufficiently elastic back side as well).

During motion, bra 200 stabilizes the breasts and minimizes upward, downward and side-to-side bounce. Where middle support layer 240 is incorporated into a sports bra, upper right and left bands 246 and 248 reduce lateral motion, while bands 242 and 244 reduce upward and downward breast motion. Bands 242 and 244 additionally provide the suspensory support described above, and additionally cross between the breasts to further stabilize and aid in reducing side-to-side bounce. Compression provided by the exterior fabric of bra 200 (and enhanced by any additional spacer layer) presses the breasts against the wearer's chest to further limit motion. Exterior bra fabric may be a single jersey, 4-way stretch circular knit, yarn wicking fabric, to provide compression and moisture management through elastic and wicking properties of the fabric, respectively. In one aspect, bra 200 is made with 79% polyester wicking fabric as commonly sold under the trademark COOLMAX® and 21% man-made elastane or spandex technical fabric as commonly sold under the trademark Lycra®. Like bra 100, layers and components of bra 200 are adjoined by sewing, heat adjoining or any other suitable method for adjoining fabrics. Seams of bra 200 may be flat lock stitched or otherwise stitched in such a way that they lie flat and preferably are sewn such that the edges of adjoining pieces are faced inward toward and against the garment fabric itself, as opposed to rubbing against the wearer's skin.

Bra 200 is sewn or otherwise adjoined into one piece and is put on by pulling over the wearer's head and shoulders. A wearer for example pulls the bra over the head and down over the breasts, lifting each breast into the appropriate molded cups (i.e., cups 124) and then adjusting position of band 212 and straps 210 as necessary. Bra 200 may be removed by simply gripping band 212, stretching it outward and pulling it up and over the head. By eliminating eyehooks, zippers, Velcro® and other common fasteners, bra 200 reduces chafing, rubbing, pressure marks and abrasions that might be caused by such fasteners rubbing against the wearer's skin Advantageously, the continuous, one piece design of bra 200 also reduces bra failure, as there are no temporary fasteners to break, bend or over stretch.

Figure 12:
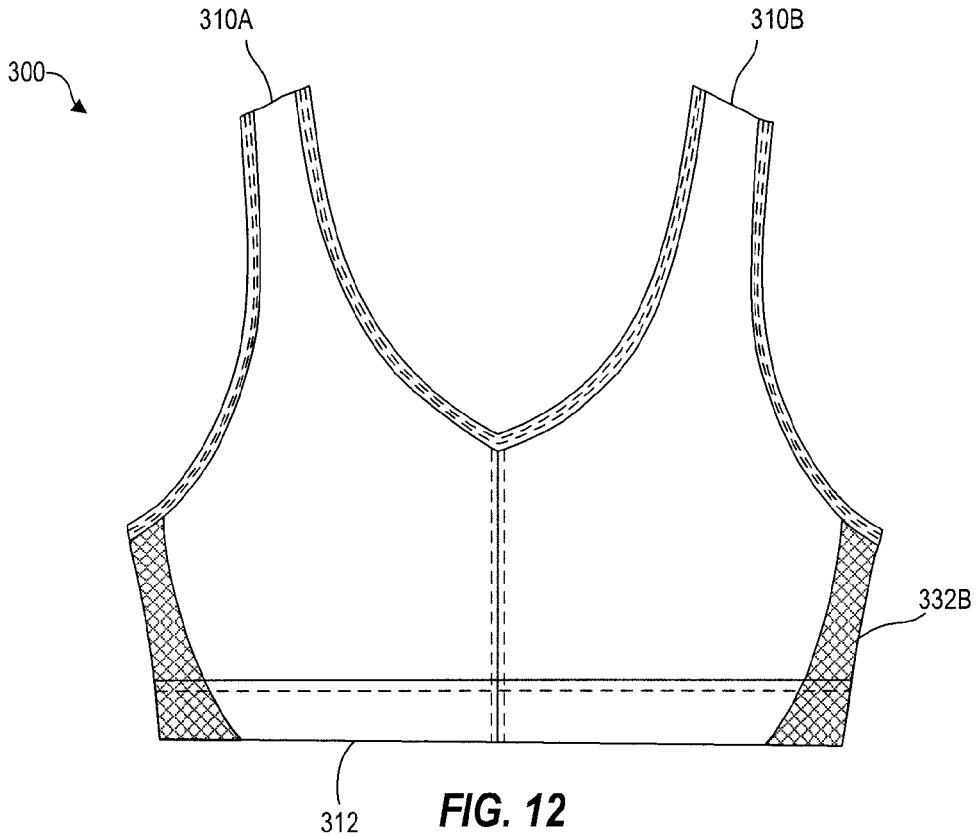
FIG. 12 is a front view of an alternately designed athletic sports bra, according to an embodiment.
Figure 13:
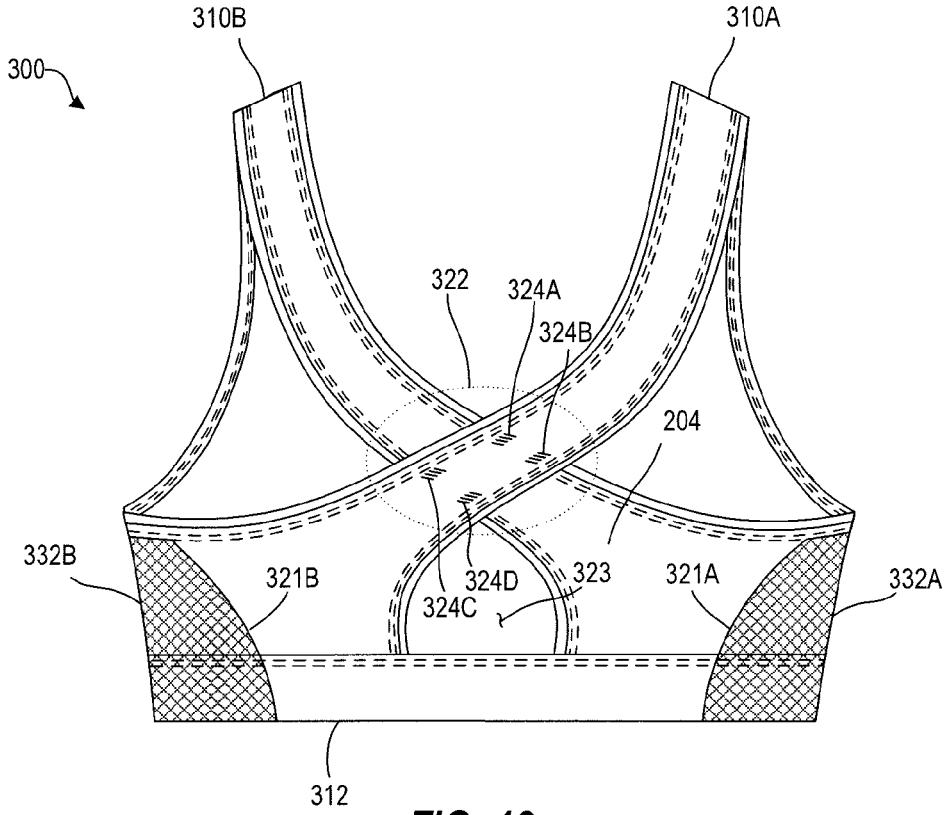
FIG. 13 is a back view of the sports bra of FIG. 12.

FIGS. 12 and 13 are respective front and back views of an assembled bra 300, which differs in design from bra 100 but includes all support layers and components described with respect thereto (e.g., exterior shell 103, support layer 140 liner 120, straps 110, band 112, etc.). Like components are given like numbering. Whereas bra 100 was primarily described as having shoulder straps 110 that adjoined with back 104 at a wearer's upper back, bra 300 has continuous straps 310 that cross and join with right and left side panels 332A and 332B (similar to panels 132 of bra 100) to form back 304 of bra 300. Thus, rear shoulder junctions 321 of bra 300 are proximate the bottom of a wearer's shoulder blades. As shown, shoulder straps 310 form a rear opening 323 to facilitate ventilation and cooling. In one aspect, straps 310A and 310 B are bar tacked at a rear intersection or overlap 322 (shown bounded by a dotted line), for example at points 324 A-D. Bar tacking reduces movement and overall elasticity of straps 310, thus enhancing support of bra 300. On the front exterior of bra 300, shoulder straps 310A and 310B join seamlessly with exterior layer 303. For example, straps 310 and the majority fabric of exterior layer 303 form the front and back exterior of bra 300. It will be appreciated that middle support and liner layers (e.g., support layer 140 and liner 120) may join with bra 300 at seams invisible from the outside of bra 300.

FIG. 13 shows alternate front styling of a sports bra 300 that incorporates structural and support features of bra 100 (e.g., structural support layer 140, liner 120 and spacer layer 170). Although shown with a center, front panel 302 that does not divide bra 300 into right and left halves, it will be appreciated that support layer 140 and liner 120 within bra 300 provide separation, encapsulation and suspension of a wearer's breasts as described above, while fabric of an exterior layer 303 compresses the breasts and underlying layers of bra 300 for additional support.

Figure 14:
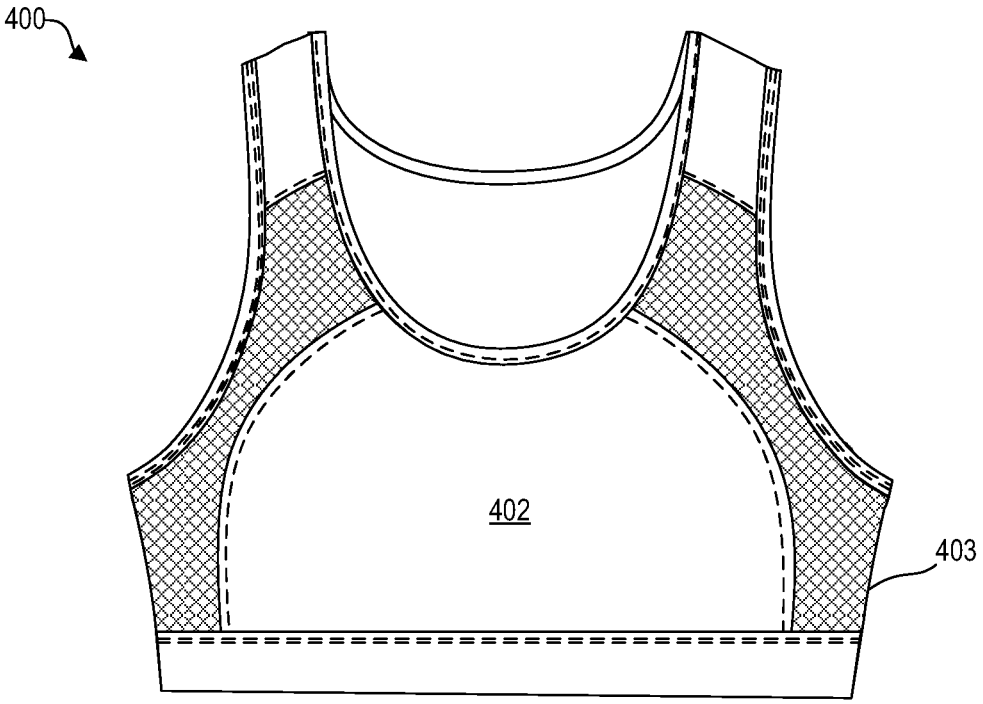
FIG. 14 is a front view of an alternately designed athletic sports bra, according to an embodiment.
Figure 15:
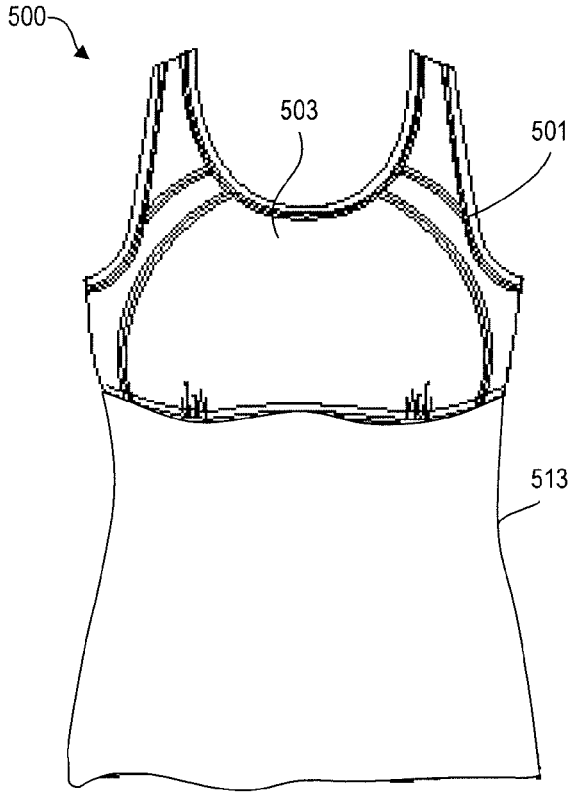
FIGS. 15 and 16 are respective front and back views of a sports tank incorporating an athletic sports bra, according to an embodiment.
Figure 16:
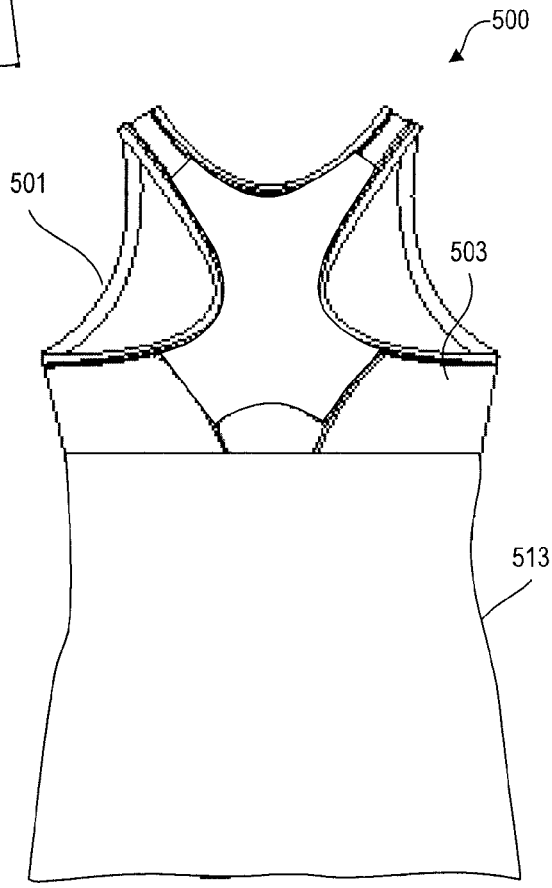
Figure 17:
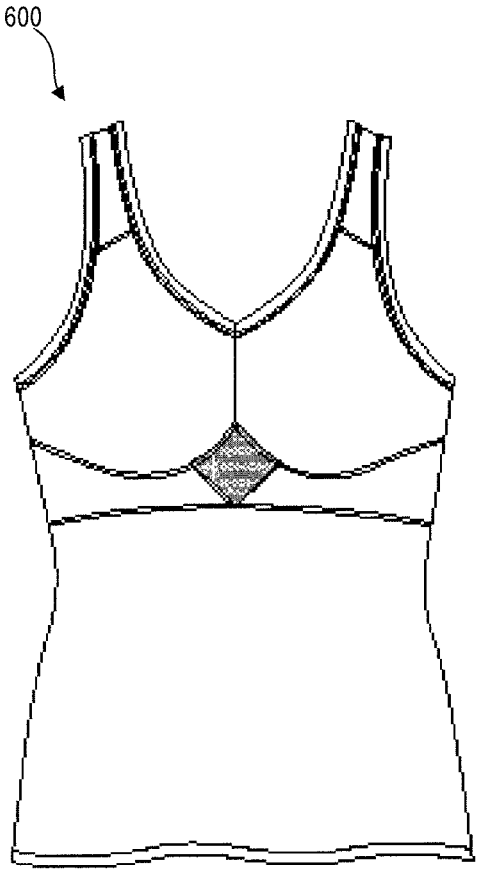
FIGS. 17 and 18 are respective front and back views of an alternately designed sports tank incorporating an athletic sports bra, according to an embodiment.
Figure 18:
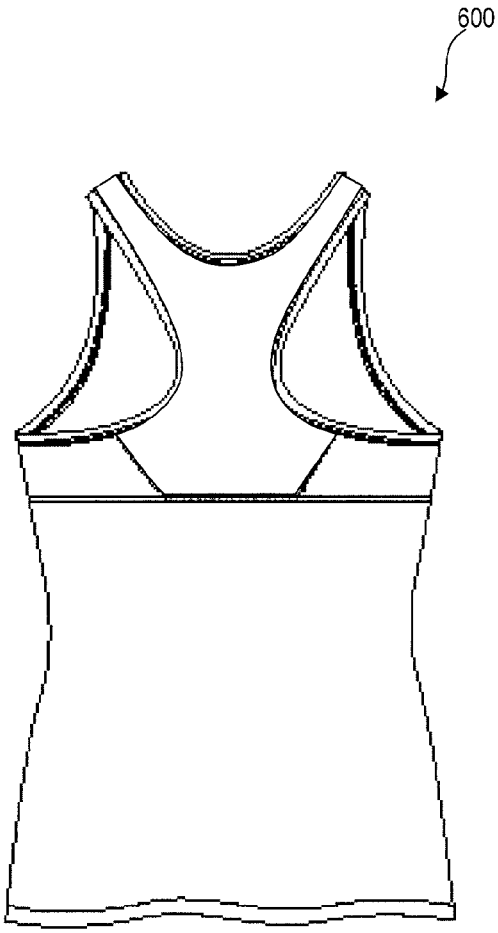

FIG. 14 is a front view of an alternately styled sports bra 400, which incorporates interior features of bra 100. Bra 400 is shown with an exterior shell 403 of a front side 402 facing out. FIGS. 15-16 and 17-18 are front and back views of sports tanks 500 and 600 (respectively) incorporating support and structural features of bra 100. Sports tank 500 incorporates a bra 501 that includes support features of bra 100. For example, although not shown, tank 500 includes a mid-layer support with overlaid m-shaped and w-shaped layers (i.e., structural support layer 140) for providing suspension and encapsulation support, and may also include an interior liner layer with seamless, molded cups (i.e., liner 120) for further encapsulating a wearer's breasts. Fabric of an exterior layer 503 enhances support by lending compression to the suspension and encapsulation of tank 500. A trunk portion 513 extends from bra 501 to cover part or all of a user's stomach, sides and mid to lower back. It will be appreciated that trunk portion 513 may be sewn or otherwise bonded with a ribcage band (e.g., band 112, FIGS. 1-2) of incorporated bra 501, either over or under the band so that the band is alternately visible or invisible when tank 500 is worn. Trunk portion 513 may be made from a lightweight, stretchable performance fabric that conforms to the wearer's body and wicks moisture to keep the wearer cool and dry during exercise. FIGS. 17 and 18 show alternate styling for a sports tank 600 incorporating bra 100 or a differently-styled bra with a middle support layer and other bra layers and features described herein above.

Figure 19:
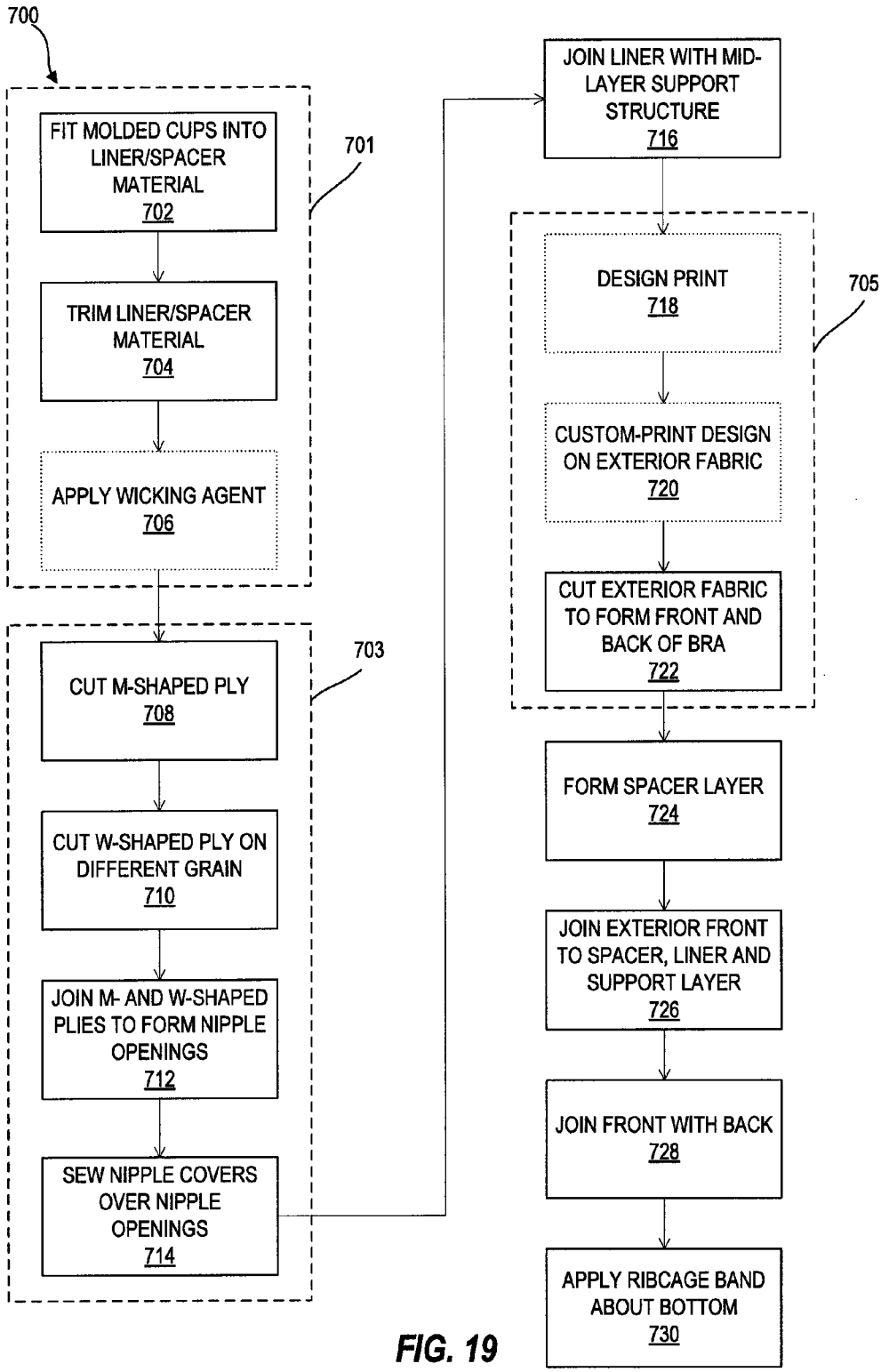
FIG. 19 is a flow chart depicting a method of fabricating an athletic support bra, according to an embodiment.

FIG. 19 illustrates a method 700 of fabricating a sports bra. It will be appreciated that the steps of method 700 may be carried out in an order other than that laid out below.

In steps 702-706 (outlined by dashed box 701), a bra liner is formed. In step 702, two pre-molded, rounded or slightly bullet-shaped bra cups are fitted into a liner or spacer material, such that un-molded spacer material extends beyond the molded cups to form an inside liner for other areas of a sports bra (such as the upper chest, the area between the breasts, the ribcage lateral to the breasts, the shoulder straps and/or the ribcage below the breasts). The cups may be heat molded or otherwise molded. The additional spacer material extending from the cups is trimmed into a desired shape and desired dimensions, in step 704. Optionally, the cups and/or complete bra liner is treated with a wicking agent, in step 706. The spacer material used in steps 702-704 is for example a spongy nylon/spandex fabric blend, a soft stabilizing tricot, tech sheen or another active wear fabric such as a lightweight wicking foam or other material able to hold its shape after molding. It will be appreciated that the steps of forming a bra liner may be carried out in an order other than shown in FIG. 19. For example, the liner may be cut to shape prior to placement of pre-molded cups.

A mid-layer support structure is formed in steps 708-714 (outlined by dashed box 703). In step 708, a layer of supportive fabric is cut to form a roughly m-shaped layer. In step 710, a roughly w-shaped layer is cut from the same or different supportive fabric, at a different grain than the m-shaped layer. For example, if the m-shaped layer is cut cross grain, the w-shaped layer is cut straight grain, and vice versa. In step 712, the m- and w-shaped layers are sewn together such that open areas farmed by each "letter" overlap to form openings for accommodating a wearer's nipple area. Nipple covers are sewn over the openings, in step 714. In one example of steps 708-714, m-shaped ply 154 is cut cross-grain from tech sheen, and w-shaped ply 144 is cut straight grain from the tech sheen. Ply 154 is laid over ply 144 (or vice versa) such that cutouts 156 and 146 overlap to form pockets 166, and the layers are joined with a flat lock, zigzag or other stitch that encourages plies 154 and 144 to lie flat against one another. Nipple covers 168, which may be pre-made or formed as an additional step of method 700, are sewn over pockets 166.

The liner and mid-layer support structure are joined together, in step 716. In one example of step 716, support layer 140 is fitted over cups 124 formed in steps 602-606 such that nipple covers 168 fit over a nipple area or apex of the cups, and the liner and support layer are sewn together, e.g., along a perimeter of the support layer and liner, and optionally, about the molded cups and/or down a centerline between the cups as well.

An exterior sports bra layer is formed in steps 718-722 (outlined by dotted box 705). In optional step 718, a fabric print is custom designed. In optional step 720, the design is printed onto a performance compression fabric, such as a dense, 4-way stretch polyester wicking fabric as commonly sold under the trademark COOLMAX® and man- made elastane or spandex technical jersey fabric as commonl sold under the trademark Lycra®. In step 722, the exterior fabric is cut to desired dimensions for a front and a back of a given bra size (e.g., 36C, 34D, small, medium or large). It will be appreciated that step 718 (fabric design) need not occur in the sequence shown, but may be designed long before it is printed (step 720) and the printed fabric cut (step 722). Likewise, the fabric to be cut need not be printed immediately prior to cutting, but may be printed weeks, months or longer before it is cut in step 722.

A spacer layer is formed, in step 724. In one example of step 724, spacer layer 170 is cut to dimensions compatible with the bra being formed. Spacer layer 170 is for example cut from a spongy nylon/spandex fabric blend, a soft stabilizing tricot, a lightweight foam, tech sheen or another active wear fabric having wicking properties. The exterior front side of the bra is joined with the spacer, inner liner and mid-layer support structure, in step 726. In one example, the layers are sewn together such that the liner forms a skin-contact side of the front of the sports bra, the mid-layer support structure lies between the liner and the spacer layer, and the bra exterior covers the spacer layer.

The bra is completed in steps 728 and 730, in which front and back exterior sides of the bra are sewn together, and a ribcage band (e.g., woven elastic) is applied about the bottom border of the bra.

It will be appreciated that interior bra layers formed in method 700 (for example, the liner or spacer layers) may be cut to form strap liners. Alternately, where interior bra layers do not extend to the bra straps, additional strap liners may be cut and sewn with bra straps formed by the exterior bra layer.

Figure 20:
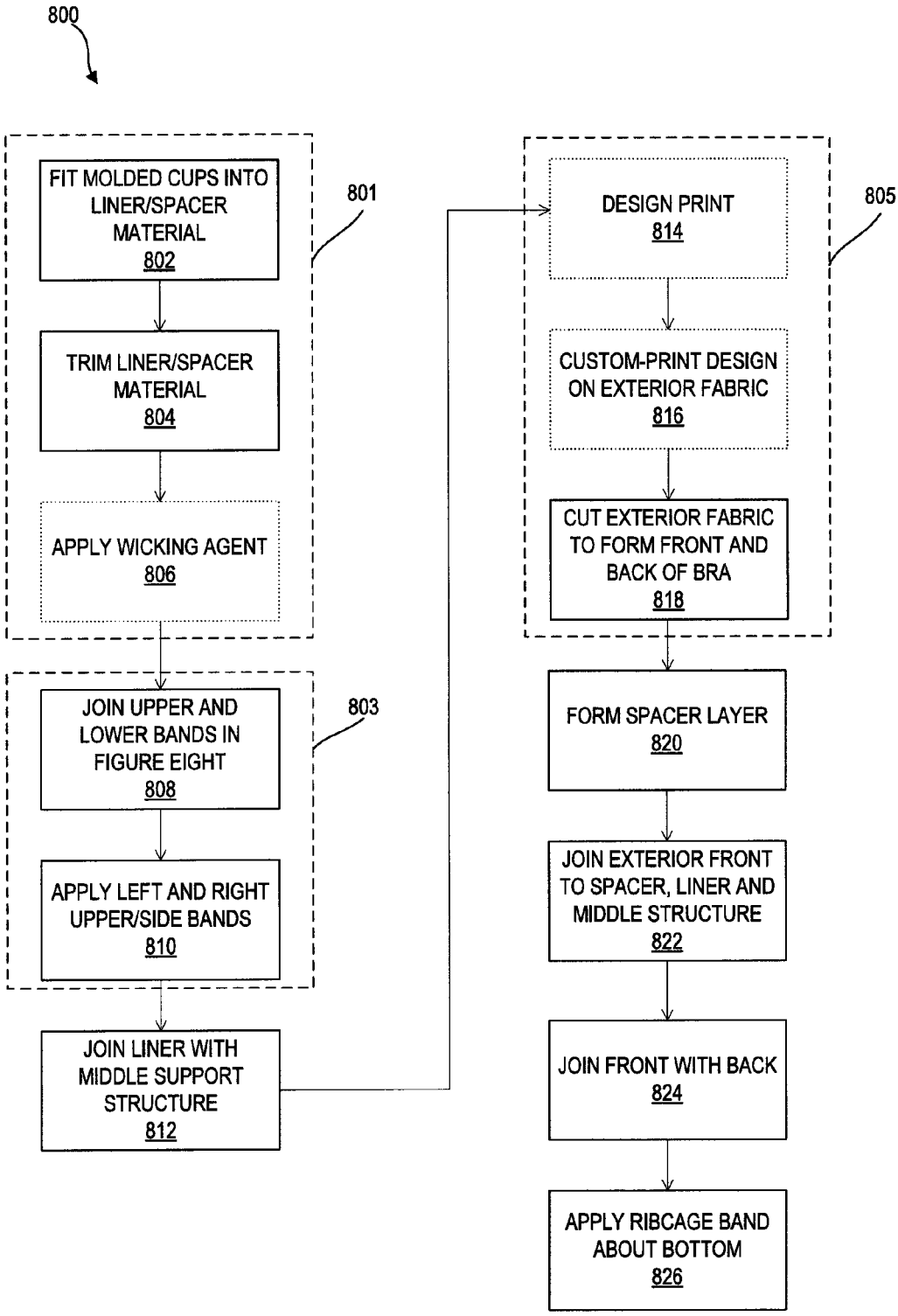
FIG. 20 is a flow chart depicting another method of fabricating an athletic support bra, according to an embodiment.

FIG. 20 illustrates a method 800 of fabricating a sports bra incorporating the support structure of FIG. 11. It will be appreciated that the steps of method 800 may be carried out in an order other than that laid out below.

In steps 802-806 (outlined by dashed box 801), a bra liner is formed as described above with respect to steps 702-706. Bra cups are fit into liner/spacer material in step 802, spacer material is trimmed in step 804 and the cups and/or complete liner is treated with a wicking agent, in step 806. See the above description of steps 702-706 for additional details and options.

A mid-layer figure-eight support structure is formed, in steps 808-810 (outlined by dashed box 803). In step 808, upper and lower support bands are joined in a figure-eight configuration, for example by sewing with a flat lock, zigzag or other stitch that encourages the bands to lie flat against one another. Left and right side-to-upper bands are joined along upper/lateral aspects of the figure-eight structure, in step 810.

The liner and mid-layer support structure are joined together, in step 812. In one example of step 812, the pre-molded cups of the formed liner are fitted into central pockets formed by the figure-eight structure of steps 808-810, and the liner and support structure are sewn together to keep the cups in place within the figure-eight structure. For example, the figure eight structure and the liner are sewn together along the perimeter of the figure eight structure, and optionally, about the molded cups as well.

An exterior sports bra layer is formed in steps 814-818 (outlined by dotted box 805). In optional step 814, a fabric print is custom designed. In optional step 816, the design is printed onto a performance compression fabric, and in step 818, the exterior fabric is cut to desired shape and dimensions. See steps 718-722 of FIG. 19 for additional detail. As noted above with respect to FIG. 19, fabric need not be designed and printed immediately prior to cutting. Rather, these steps may occur days, weeks, months or years prior to step 818.

A spacer layer is formed, in step 820. In one example of step 820, spacer layer 170 is cut to dimensions compatible with the bra being formed. Spacer layer 170 is for example cut from a spongy nylon/spandex fabric blend, a soft stabilizing tricot, a lightweight foam, tech sheen or another active wear fabric having wicking properties. The exterior front side of the bra is joined with the inner liner, mid-layer support structure and spacer, in step 822. The layers may be sewn together such that the mid-layer support structure is secured between the liner and bra exterior. As with steps 728 and 730 of FIG. 19, front and back sides of the bra are sewn together in step 824, and a ribcage band is applied about the bottom border of the bra, in step 826.

While the present invention has been described above, it should be clear that many changes and modifications may be made to the process and product without departing from the spirit and scope of this invention. For example, features of bra 100 may be combined with any bra or sports tank described herein, or other garment incorporating a sports bra. Alternately, different fabrics that provide the same or similar function to those described above may replace or compliment the specific types described herein.

What is claimed is:

1. A two-ply structural support layer for a bra, comprising:

an m-shaped ply of compression fabric forming left and right openings along a bottom aspect of the m-shaped ply; and a continuous, one-piece w-shaped ply of compression fabric forming left and right openings along a top aspect of the w-shaped ply; the w-shaped ply joined with the m-shaped ply such that: (a) a midline of the m-shaped ply overlaps a midline of the w-shaped ply, and (b) the left and right openings in the w-shaped ply overlap with left and right openings in the m-shaped ply to form left and right pockets for accommodating at least a portion of a wearer's breasts.

2. The structural support layer of claim 1, further comprising left and right nipple covers attached with the two-ply structural support layer to cover the left and right pockets and minimize appearance of the wearer's nipples.

3. The structural support layer of claim 1, wherein the w-shaped ply and the m-shaped ply are cut on different grains, and wherein different stretch abilities of the plies enhance bust support.

4. An internal support structure for a bra, comprising:

a two-ply structural support layer including:

an m-shaped ply of compression fabric forming left and right openings along a bottom aspect of the m-shaped ply, and a one-piece w-shaped ply of compression fabric forming left and right openings along a top aspect of the w-shaped ply; the w-shaped ply joined with the m-shaped ply such that (a) the w-shaped ply and the m-shaped ply overlap at a midline of the internal support structure, and (b) the left and right openings of the plies overlap to form left and right pockets for accommodating at least a wearer's nipples; and an interior liner for contacting a wearer's skin; the liner joined with an interior aspect of the two-ply structural layer and having left and right molded cups fitted at least partially into the left and right pockets, for accepting and encapsulating the wearer's left and right breasts.

5. The internal support structure of claim 4, further comprising left and right nipple covers attached with the two-ply structural support layer to cover and pad the wearer's nipples.

6. The internal support structure of claim 5, further comprising a layer of spacer fabric joined with the two-ply structural support layer over the nipple covers, the spacer fabric further minimizing appearance of the wearer's nipples.

7. The internal support structure of claim 4, further comprising a layer of spacer fabric joined with an exterior side of the two-ply structural support layer, for minimizing appearance of the wearer's nipples.

8. The internal support structure of claim 4, wherein the w-shaped ply and the m-shaped ply are cut on different grains, providing different stretch abilities.

9. An athletic support bra providing suspension, encapsulation and compression, and comprising:

an exterior front shell made of a compressive fabric to reduce motion of a wearer's breasts during exercise;

a spacer layer beneath the exterior front shell, for minimizing appearance of a wearer's nipples, camouflaging underlying layers and enhancing breast compression;

a two-ply structural support layer beneath the spacer layer and including a w-shaped ply of fabric and an m-shaped ply of fabric joined to form left and right breast pockets;

a liner layer beneath the two-ply structural support layer, the liner layer including cups formed from a spacer material and joined with the two-ply structural support layer such that the cups fit at least partially within the left and right pockets;

left and right shoulder straps formed with or joined with the exterior front shell and further joined with the spacer layer, the two-ply structural support layer and the liner layer;

an exterior back side made with a compressive fabric and joined with (a) the shoulder straps, and (b) at least the exterior front shell; and elastic joined with a bottom border of the athletic support bra to form a continuous ribcage band;

wherein the two-ply structural support layer and the liner layer encapsulate the wearer's breasts, a juncture of the straps with the two-ply structural support layer provides suspension support of the breasts, and the compressive fabric compresses the breasts to the wearer's chest.

10. The bra of claim 9, the two-ply structural support layer further comprising left and right nipple covers positioned with the left and right pockets, to cover and pad the wearer's nipples.

11. The bra of claim 9, wherein the w- and m-shaped plies of the two-ply structural support layer are cut on different grains.

12. The bra of claim 9, wherein one of the m-shaped ply and the w-shaped ply is cut straight grain from tech sheen fabric, and the other of the m-shaped ply and the w-shaped ply is cut cross grain from tech sheen fabric.

13. The bra of claim 9, the two-ply structural support layer comprising a material selected from the group of tech sheen and powernet.

14. The bra of claim 9, the exterior front shell comprising a material selected from the group consisting of a compression jersey fabric, a dense, 4-way stretch wicking polyester and man-made elastane technical fabric, and a fabric having 79% wicking polyester and 21% man-made elastane.

15. The bra of claim 9, the liner layer comprising a material selected from the group of a nylon/spandex fabric blend, a spongy 90% nylon/10% spandex material, tech sheen, a material including 75-80% denier nylon and 20-25% man-made elastane, a soft stabilizing tricot, and a spacer fabric.

16. The bra of claim 9, wherein the shoulder straps are lined with spacer material, and wherein seams between the straps and the front and back of the bra are offset from a top of the wearer's shoulders, to reduce rubbing and chafing.

17. The bra of claim 9, the cups comprising seamless, molded cups.

18. The bra of claim 9, wherein the two-ply structural support layer provides superior, inferior, medial and lateral support to the breasts.

19. The bra of claim 9, the cups molded by heat molding.

20. The bra of claim 9, wherein each cup is formed as a unitary piece.

* * * * *